United States Patent [19]

Lekas

[11] 4,037,657

[45] July 26, 1977

[54] PROCESS FOR RECOVERY OF CARBONACEOUS MATERIALS FROM SUBTERRANEAN DEPOSITS BY IN SITU PROCESSING

[76] Inventor: Mitchell A. Lekas, 1015 Bermuda Drive, Concord, Calif. 94518

[21] Appl. No.: 610,694

[22] Filed: Sept. 5, 1975

[51] Int. Cl.[2] ..... E21B 43/24; E21B 43/26

[52] U.S. Cl. ..... 166/271; 166/259; 166/272; 166/299

[58] Field of Search ..... 166/271, 272, 281, 256, 166/259, 299; 299/4, 13

[56] References Cited

U.S. PATENT DOCUMENTS

| | | | |
|---|---|---|---|
| 1,872,016 | 8/1932 | Sherwood et al. | 299/13 |
| 3,291,215 | 12/1966 | Nichols | 166/259 |
| 3,409,082 | 11/1968 | Bray et al. | 166/272 X |
| 3,455,383 | 7/1969 | Prats et al. | 166/272 X |
| 3,674,089 | 7/1972 | Moore | 166/299 X |
| 3,841,705 | 10/1974 | Girard et al. | 166/271 X |
| 3,902,422 | 9/1975 | Coursen | 299/13 X |

FOREIGN PATENT DOCUMENTS

| | | | |
|---|---|---|---|
| 812,573 | 9/1951 | Germany | 299/2 |

*Primary Examiner*—Stephen J. Novosad
*Assistant Examiner*—George A. Suchfield
*Attorney, Agent, or Firm*—Brown & Martin

[57] ABSTRACT

Subterranean carbonaceous deposits, such as oil shale or the like, that are located at or close to the surface, are prepared for retorting by drilling blast holes from the surface into the deposit, and blasting, creating a rubble pile that reaches the surface. The surface is sealed by suitable means, and the oil shale is retorted in place. Where a stratum of barren rock lies between the carbonaceous deposit and the surface, the blast holes are drilled and blasted in such a manner as to maximize the fragmentation of the carbonaceous deposit, and minimize the fragmentation of the overlying barren stratum. Where overburden conditions are not suitable for treatment by this method, the overburden is removed by strip mining methods, and the carbonaceous deposits are exposed for treatment by the method described above.

16 Claims, 8 Drawing Figures

PROCESS FOR RECOVERY OF CARBONACEOUS MATERIALS FROM SUBTERRANEAN DEPOSITS BY IN SITU PROCESSING

BACKGROUND OF THE INVENTION

The present invention relates to in situ extraction of carbonaceous values from oil shale and other carbonaceous deposits and pertains particularly to the extraction of carbonaceous values from surface and near surface formations.

It is well known that enormous deposits of subterranean carbonaceous deposits exist throughout the world today. Such deposits exist in the form of coal, oil shale, and tar sands, for example.

Commercial development of oil shale has lagged in this country because it has been unable to compete with other sources of petroleum. Several proposals for the recovery of carbonaceous values have been made in the past. These proposals have one or more drawbacks which prevent them from being economically feasible.

In situ retorting is one proposal that continues to be of interest today for deep subsurface deposits. Several approaches to in situ retorting have been proposed for such deposits. These approaches are generally exemplified by the following U.S. patents and the prior art cited therein: U.S. Pat. No. 1,913,395 issued June 13, 1933; U.S. Pat. No. 1,919,636 issued July 25, 1933; U.S. Pat. No. 2,481,051 issued Sept. 6, 1949; and U.S. Pat. No. 3,661,423 issued May 9, 1972.

These approaches involve breaking up the subterranean formation into rubble, and retorting the rubble. These processes require that a portion of the deposit be removed by mining, solution, drilling, or some other method in order to provide a free face for breakage, and to create space for bulking of the rock broken by the explosive.

Surface and near surface formations of carbonaceous deposits such as oil shale are normally mined by conventional mining methods and the materials shipped to a retorting plant built for the extraction of carbonaceous values from such materials. The plant may be located at the site of the mining operation or some distance away. After the values have been extracted from the shale, the waste products must be transported from the plant and disposed of in a suitable manner. Such an operation can become quite expensive because of the numerous handling steps within the process. Such an operation may also have ecological drawbacks unless the spent shale is deposited back in the formation and the earth restored to its original contour and surface condition.

SUMMARY AND OBJECTS OF THE INVENTION

It is the primary object of the present invention to provide a method of preparing a surface or near surface mineral formation for optimum in situ recovery of carbonaceous values therefrom.

It is another object of the present invention to provide a method of in situ recovery of carbonaceous values from surface and near surface formations.

In accordance with the primary aspects of the present invention, a predetermined portion of a near surface subterranean deposit is selected and a rubblized body or zone of shale is created by blasting to expand the material upward into the overlying space; inlet and outlets are provided for the rubblized zone and a process of recovery is initiated at the inlet, and materials driven therefrom and recovered at the outlet of the zone.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENTS

Figure 1:
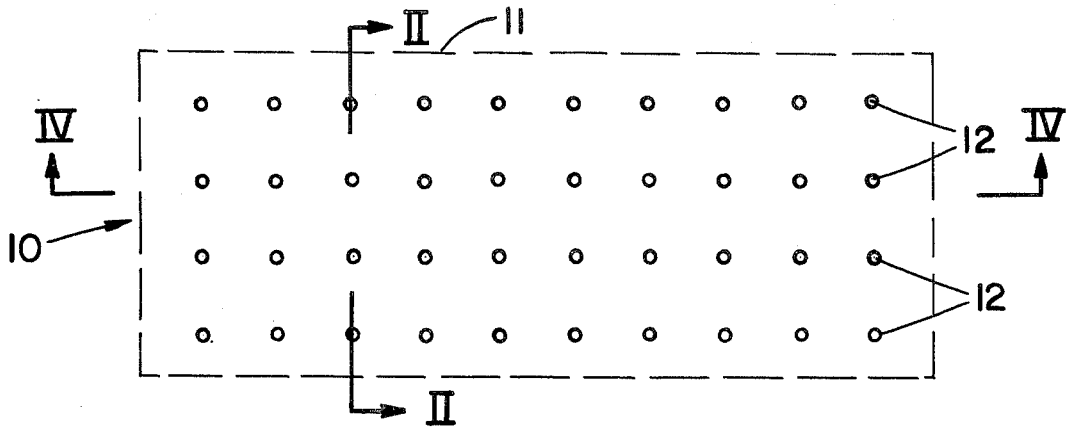
FIG. 1 is a plan view of a portion of a formation having little overburden selected for processing in accordance with the invention with blast holes drilled for fragmentation.

Turning now to FIG. 1 of the drawings, there is illustrated a layout of the surface of the earth above a preselected carbonaceous deposit. The thickness of the deposit, the overburden and the extent of the formation will be generally known from prior exploration such as coring and the like. A predetermined area may be laid out on the surface designating the desired portion of the deposit to be retorted. This area may have any suitable configuration but is preferably of a generally rectangular configuration having suitable dimension to be handled by the process. The lengths, for example, may be on the order of 200 feet with the width being anywhere from one-quarter to one-half the length of the selected portion of the formation.

A suitable array of blast holes are drilled into the formation at suitable locations to give a desired resultant breakup of the formation. The carbonaceous formation is preferably broken up into rubble in a graded manner having smaller rubble at what would be the inlet of the formation or zone and larger chunks at the outlet of the zone. This arrangement would be in order to enhance the transportation of the material through this rubblized zone to the outlet as more fully described and set forth in our copending application Ser. No. 568,900 filed Apr. 17, 1975, now U.S. Pat. No. 3,980,339, and assigned to the assignee hereof.

The blast holes and the location and strength of the charges placed within the holes are suitably located to provide the desired breaking of the rubblized zone.

Figure 3:
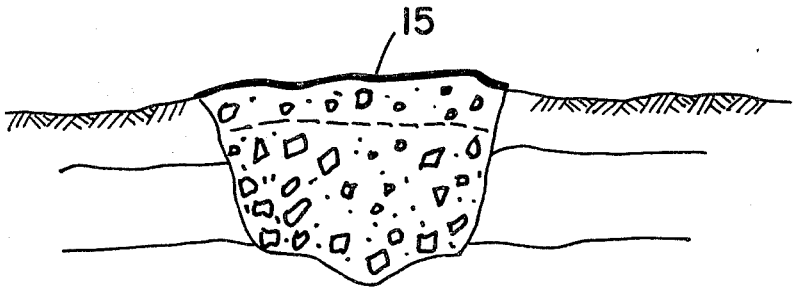
FIG. 3 is a view like FIG. 2 after blasting and fragmentation.
Figure 4:
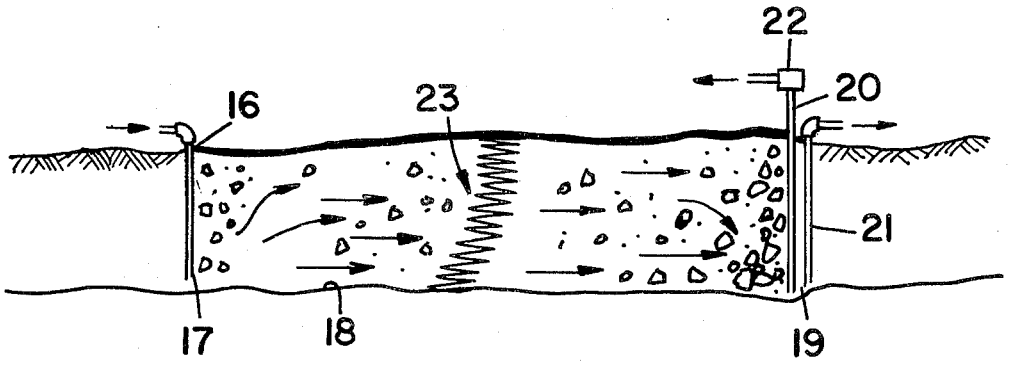
FIG. 4 is a longitudinal cross-sectional view generally along lines IV—IV of FIG. 1 showing the progression of a processing front across the prepared formation.

After the rubblized zone has been created, as best seen in FIG. 3, for example, inlet and outlet conduit means may be provided to the floor of the rubblized zone, as best seen in FIG. 4. The inlet means are primarily for the purpose of introducing suitable combustion air or gas into the formation for the initiation and controlling of a combustion or like process through the rubblized zone. The outlet means may include one or more conduit means for the extraction of oil, gas and air or other products.

As best seen in FIG. 1, a portion generally designated by the numeral 10 of a suitable formation is delineated by establishing a suitable perimeter 11 around an area on the surface above the formation. Thereafter, a plurality of blast holes 12 are formed by drilling downward into the formation and establishing a suitable array and a suitable depth to fragment the formation by blasting, as pointed out above.

Figure 2:
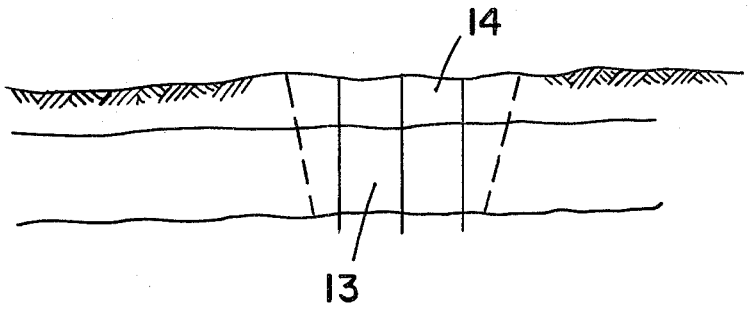
FIG. 2 is a cross-sectional view generally along lines II—II of FIG. 1.

As best seen in FIG. 2, the formation may consist of a number of layers, such as a primary layer 13 and an upper or overburden layer 14. These layers may have different carbonaceous values or percentages. The upper layer, as illustrated may, for example, contain a lower percentage of carbonaceous values and may outcrop at the surface.

As best seen in FIG. 3, the formation or the delineation portion of the formation is reduced to rubble as pointed out above by suitable blasting techniques. The reduction of a formation to rubble, as seen in FIG. 3, will cause the material to expand upward into the space above the surface of the ground above the formation. This eliminates the need for the mining of an area into which the material can expand. Once the material has been reduced to rubble, as shown in FIG. 3, suitable seal means are placed over the rubblized zone to seal the area against the passage of gases and air.

The sealing of the surface of the rubblized zone may be carried out in any suitable manner. For example, should a layer of soil exist on the surface of the formation of several inches in thickness this soil may be suitably compacted to provide the necessary seal. If such soil does not exist at the precise location, soil may be transported to the area and placed over the entire zone at a suitable thickness of up to a foot, for example, and this soil is suitably compacted. If the overburden is rock or the like and has been broken or cracked by the blasting, the cracks may be sealed such as by adding water, mud or various slurries to fill and seal the cracks. The surface may also be sealed by placing a sheet or sheets of suitable plastic or the like over the surface. It will also be appreciated that any combination of the above may be utilized.

After the portion of the formation has been reduced to rubble, inlet and outlet means are provided, as seen in FIG. 4. Suitable inlet conduit means 16 are provided in a suitable manner at one end of the formation for the introduction for air or combustion gas into the formation. Conduit means preferably communicate at a lower end 17 with the bottom of the rubblized zone. The floor 18 of the formation is preferably formed to slope from the inlet end 17 of the formation to the outlet end 19. At the outlet end, suitable conduit means 20 and 21 may be provided for communicating with the formation near the floor thereof at the outlet end 19.

The conduit means 20 may, for example, include a pump 22 for extraction of liquids such as oil or the like from the outlet end 19 of the formation. The conduit means 21 may be provided for extraction of gas or to permit the escape of air or the like from the formation.

After the formation has been prepared by the formation of the inlet and outlet means and by the sealing of the upper surface thereof, a suitable extraction process is initiated at the inlet end 17 of the formation and is forced the length of the formation to the outlet end 19 driving extracted fluids and gases from the formation. These fluids and gases are extracted in a suitable manner at the outlet end of the formation. The extraction process may be, for example, a combustion process which is initiated by the introduction of air and suitable means for initiating the combustion. The combustion process moves along a front 23 from the inlet end of the formation to the opposite end. The combustion process is controlled by controlling the introduction of air into the inlet end of the zone which is being retorted.

Figure 5:
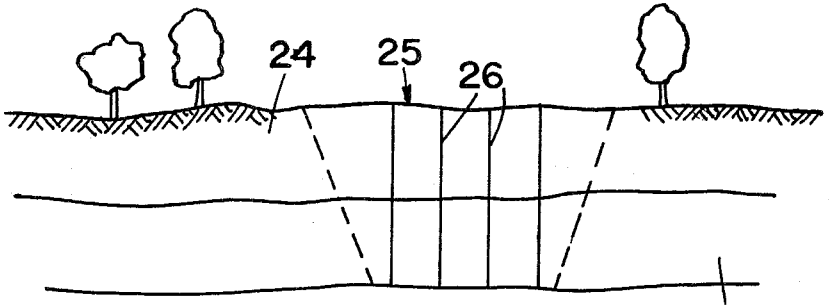
FIG. 5 is a cross-sectional view of a formation having an overburden equal to the thickness of the carbonaceous strata showing the location of the blast holes for fragmentation.

Turning now to FIG. 5, there is illustrated the cross section of a formation having a deposit or layer of carbonaceous material designated by the numeral 23 having a non-carbonaceous overburden 24 which is several feet thick and which, for example, may be a shale or other rock formation. As in the previous embodiment, a portion generally designated by the numeral 25 is delineated and a plurality of blast holes 26 in a suitable array are drilled downward from the surface to suitable depths within the ore formation or ore body 23. As in the previous embodiment, the array of blast holes is selected and depths of the blast holes and positioning of the charges as well as the type of charge is selected to obtain the desired optimum fragmentation of the ore body.

Figure 6:
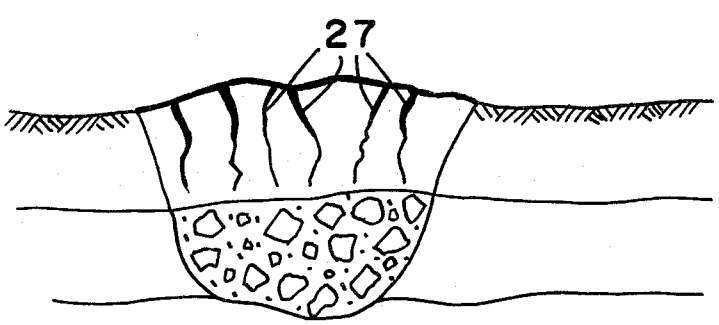
FIG. 6 is a view like FIG. 5 after blasting and fragmentation.

Turning now to FIG. 6, there is illustrated a typical arrangement of the formation after the desired portion of the formation has been reduced to rubble. As illustrated, the surface of the ground above the formation expands or extends upward into the space thereabove permitting an expansion of the formation. This may result in the formation of a plurality of cracks 27 in the overlying rock or overburden. During the sealing steps of the process, these cracks may be sealed in a suitable manner, such as by pumping a mud slurry or the like into the cracks. The top may also be sealed by means of a layer of soil or the like, or by other suitable means such as by a sheet or sheets of plastic or the like. The sealing of the cracks 27 prevents the escape of air and/or extracted gases and mist from the carbonaceous deposit during the retorting process.

Figure 7:
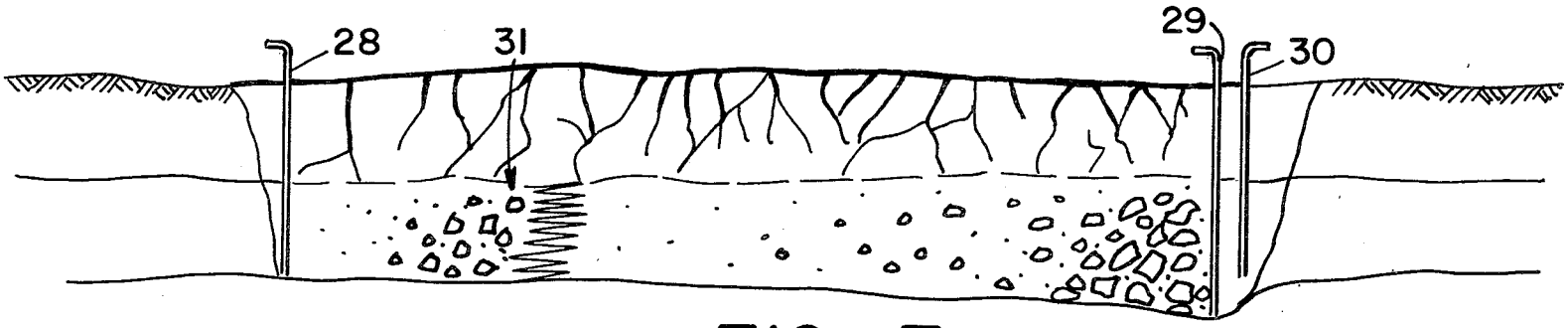
FIG. 7 is a longitudinal cross-sectional view showing the progress of a processing front across the prepared carbonaceous formation and beneath the fractured overburden; and, FIG. 8 shows an alternate process where the method is carried out by removing the overburden by strip mining methods.

Turning now to FIG. 7, there is illustrated in longitudinal cross section the formation of FIG. 5 during the process of retorting. As in the previous embodiment, inlet conduit means 28 are provided at the inlet end of the formation with outlet conduit means 29 and 30 provided at the outlet end of the formation. The conduit means appropriately communicate from the surface to the appropriate position within the rubblized zone of the formation. An extraction process is initiated at the inlet end of the formation and progresses as a front 31 from the inlet end of the formation to the outlet end. As previously described, the carbonaceous values are driven to the outlet end of the formation and extracted by means of the outlet conduit 29 and 30.

It will be appreciated that the present process can be carried out by forming the plurality of clusters of adjacent retorts separated by thin walls or partitions and the processing of these adjacent retorts can be carried out simultaneously. The advantage of such an arrangement would, of course, be the central location of equipment and personnel as well as the significant rate of production.

Figure 8:
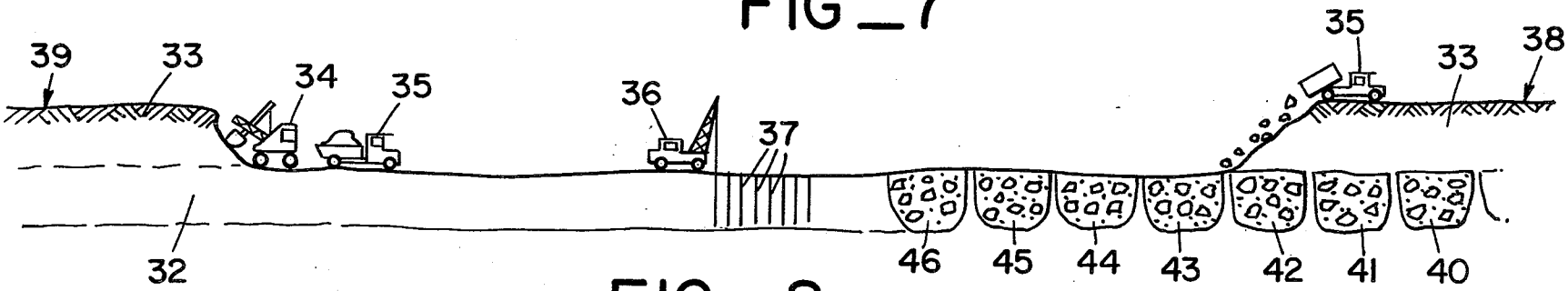

Turning now to FIG. 8, there is illustrated a cross section of a formation having a layer of oil shale or the like 32 with an overburden 33 of substantial thickness which, because of some characteristics of the overburden, does not permit processing of the body of shale in a manner as previously described. For example, the overburden may prevent the breaking of the formation in the desired manner. In such an instance, the overburden 33 is stripped away in a suitable manner by conventional strip mining techniques in accordance with the present invention. In such an instance, a suitable mining machine, such as a shovel 34, is brought in for stripping away the overburden 33 and loading it on suitable transport vehicle means such as a truck 35 for transport away from the area to permit access to the underlying shale.

After a sufficient amount of the overburden is stripped away, a suitable drilling rig or the like 36 is brought in and a suitable array of blast holes 37 are drilled into the oil shale layer or strata 32.

In general, this process is carried out beginning at one end of the formation 38 and progressing to the other end of the formation 39. This is illustrated from right to left in FIG. 8. In carrying out the process on a formation such as illustrated in FIG. 8, a first portion of the formation is delineated and prepared by stripping the overburden, drilling the blast holes, blasting the shale formation, appropriately sealing the surface of the formation, providing inlet and outlet means and then initiating a combustion or other suitable extraction process and extracting the carbonaceous values therefrom. In this process, a first retort 40 is formed and processed as in accordance with the invention as previously discussed. Either simultaneously therewith or closely following this processing, a second retort 41 is also formed and retorted as discussed. Consecutive further retorts 42, 43, 44, 45, 46 and so on, are prepared and processed in a manner as previously discussed. After the respective retorts 40, 41, etc., have been processed, the spent shale and the like is left in place and the overburden which has been stripped or which is being stripped from the head of the retort preparation is returned in place over the retorting sites, as illustrated at 35. This process then returns the site to its original configuration.

From the above discussion or description it is seen that we have provided an improved process for the recovery of materials from subterranean deposits. In accordance with the process, a predetermined portion of a desired subterranean deposit is selected and its confines delineated by blasting to create a rubblized body of oil shale. An inlet and an outlet for the deposit is provided and the deposit broken up in a manner to provide a gradation of fine materials at the inlet to coarse materials at the outlet to provide a progressively more permeable formation from the inlet to the outlet. A process of recovery is initiated at the inlet and recovered materials driven through the permeable portion of the formation to the outlet and thereat recovered.

The process according to the present invention can be carried out on surface and near surface formations because of its low pressure requirements. The low pressure requirements may be attributable to the flow efficiency of the prepared formation which I herein term a retort. A gradation of the rubble, as pointed out above, from a fine rubble at the inlet of the retort increasing gradually to a coarse rubble at the outlet of the retort provides a high efficiency of flow of both gases and viscous liquids through the formation or retort. This increase in size of rubble increases the size of channels for flow of fluid (both gas and liquid) between the particles of rubble. Because of this efficiency, the process can be carried out at very low positive pressures. For example, by positive pressure, I mean pressure relative to the prevailing atmospheric pressure. This low pressure requirement in turn permits surface and near surface retorting operations to be carried out with low pressure sealing of the retort. However, higher pressure of up to 10 or 15 PSI may be used if the sealing has been carefully prepared. These higher pressures can be handled if thicker and/or heavier layers of sealing material is used.

Pressure of less than prevailing atmospheric pressure can also be used in accordance with the present process. This is accomplished by drawing air into the inlet by applying a partial vacuum at the outlet 19. Such partial vaccum can be for example as low as one pound per square inch. Air or a combustion gas is permitted to flow into the inlet to initiate and/or control the process. This partial vacuum can be created such as by drawing air out of the retort at the outlet end 19 by means of pump 22. The advantages of using a vacuum is that the sealing of the retort is less critical and can be less expensive as well as less of a problem.

Reacting fluids for starting and/or controlling the extraction process may be introduced into the inlet to the prepared formation at very low pressure. The reacting fluids may be air or a combustible gas, for example. Once a process such as burning, for example, is started, it may be controlled by the introduction of air. Sufficient residual combustion material may be left from the extraction process to sustain a combustion for driving the carbonaceous values from the formation.

While the present invention has been described with respect to specific embodiments, it is to be understood that numerous changes and modifications may be made therein without departing from the spirit and scope of the invention as defined in the appended claims.

What is claimed is:

1. A process for the in situ recovery of carbonaceous values from subterranean deposits comprising the steps;

breaking a portion of a subterranean carbonaceous deposit into rubble for thereby forming a zone of permeability;

raising the surface of the earth over said portion upward for accomodating the expansion of said portion of said deposit upward;

sealing at least the surface over said portion of said formation by placing sealing means in contact with said entire surface over said portion;

providing inlet means for communicating reacting fluid for initiating and controlling an extraction process within said zone of permeability;

forming an outlet communicating with said zone of permeability beneath said surface for withdrawing carbonaceous values from said deposit;

initiating an extraction process near said inlet for driving said carbonaceous values from said deposit by way of said outlet; and continuing said extraction process while simultaneous therewith withdrawing said values from said deposit.

2. The process of claim 1 wherein the process of breaking said formation and raising said surface is carried out by placing explosives in said formation and detonating said explosives.

3. The process of claim 2 including the steps of drilling a plurality of blast holes from the surface into said formation and loading said blast holes with said explosives.

4. The process of claim 3 including the step of:

stripping a substantial portion of the overburden from above said formation prior to drilling said blast holes.

5. The process of claim 4 including the further step of replacing said overburden after said extraction process has been completed.

6. The process of claim 2 wherein said step of sealing said surface is carried out by covering said surface with one or more thin sheets of impervious material.

7. The process of claim 1 comprising the steps of:

breaking said formation to form a plurality of zones of permeability separated by thin substantially unbroken walls of material of said formation; and, simultaneously carrying out a process of extraction in said plurality of zones.

8. A process for the in situ recovery of carbonaceous values from subterranean deposits comprising the steps;

breaking a portion of a subterranean carbonaceous deposit into rubble for thereby forming a zone of permeability;

raising the surface of the earth over said portion upward for accomodating the expansion of said portion of said deposit upward;

wherein the steps of breaking said formation and raising said surface are carried out by placing explosives in said formation and detonating said explosives;

sealing at least the surface over said portion of said formation by covering said surface with native soil;

providing inlet means for communicating reacting fluid for initiating and controlling an extraction process within said zone of permeability;

forming an outlet communicating with said zone of permeability for withdrawing carbonaceous values from said deposit;

initiating an extraction process near said inlet for driving said carbonaceous values from said deposit; and continuing said extraction process while simultaneous therewith withdrawing said values from said deposit.

9. A process for the in situ recovery of carbonaceous values from subterranean deposits comprising the steps;

breaking a portion of a subterranean carbonaceous deposit into rubble for thereby forming a zone of permeability;

raising the surface of the earth over said portion upward for accomodating the expansion of said portion of said deposit upward;

sealing at least the surface over said portion of said formation;

providing inlet means for communicating reacting fluid for initiating and controlling an extraction process within said zone of permeability;

forming an outlet communicating with said zone of permeability for withdrawing carbonaceous values from said deposit;

initiating an extraction process near said inlet for driving said carbonaceous values from said deposit; and continuing said extraction process while simultaneous therewith withdrawing said values from said deposit;

wherein the process of breaking said formation and raising said surface is carried out by placing explosives in said formation and detonating said explosives; and said step of sealing said surface comprises covering said surface with a slurry of mud.

10. A process for the in situ recovery of carbonaceous values from subterranean deposits comprising the steps;

breaking a portion of a subterranean carbonaceous deposit into rubble for thereby forming a zone of permeability;

raising the surface of the earth over said portion upward for accomodating the expansion of said portion of said deposit upward;

sealing at least the surface over said portion of said formation;

providing inlet means for communicating reacting fluid for initiating and controlling an extraction process within said zone of permeability;

forming an outlet communicating with said zone of permeability for withdrawing carbonaceous values from said deposit;

initiating an extraction process near said inlet for driving said carbonaceous values from said deposit; and continuing said extraction process while simultaneous therewith withdrawing said values from said deposit;

wherein the process of breaking said formation and raising said surface is carried out by drilling a plurality of blast holes from the surface into said formation and loading blast holes with explosives and detonating said explosives; and the steps of drilling said blast holes and loading said blast holes are carried out in a manner for maximizing the breaking of said formation and minimizing the breaking of any overburden.

11. The process in accordance with claim 10 wherein the step of communicating reacting fluid to said formation for controlling said extraction process is carried out at a pressure of less than one pound per square inch.

12. The process of claim 11 wherein the step of breaking said formation is carried out in such a manner as to provide a gradation of said rubble from a fine rubble at said inlet to the formation to a coarse rubble at said outlet.

13. The process in accordance with claim 10 wherein the step of communicating reacting fluid to said formation for controlling said extraction process is carried out at a pressure of less than prevailing atmospheric pressure.

14. A process for the in situ recovery of carbonaceous values from subterranean deposits comprising the steps:

breaking a portion of a subterranean carbonaceous deposit into rubble for thereby forming a zone of permeability;

raising the surface of the earth over said portion upward for accomodating the expansion of said portion of said deposit upward;

sealing at least the surface over said portion of said formation;

providing inlet means for communicating reacting fluid for initiating and controlling an extraction process within said zone of permeability;

forming an outlet communicating with said zone of permeability for withdrawing carbonaceous values from said deposit;

initiating an extraction process near said inlet for driving said carbonaceous values from said deposit; and continuing said extraction process while simultaneous therewith withdrawing said values from said deposit;

wherein the step of communicating reacting fluid to said formation is carried at a pressure of less than one pound per square inch.

15. The process of claim 14 wherein the step of breaking said formation is carried out in such a manner as to provide a gradation of said rubble from a fine rubble at said inlet to the formation to a coarse rubble at said outlet.

16. A process for the in situ recovery of carbonaceous values from subterranean deposits comprising the steps:

breaking a portion of a subterranean carbonaceous deposit into rubble for thereby forming a zone of permeability;

raising the surface of the earth over said portion upward for accomodating the expansion of said portion of said deposit upward;

sealing at least the surface over said portion of said formation;

providing inlet means for communicating reacting fluid for initiating and controlling an extraction process with said zone of permeability;

forming an outlet communicating with said zone of permeability for withdrawing carbonaceous values from said deposit;

initiating an extraction process near said inlet for driving said carbonaceous values from said deposit; and continuing said extraction process while simultaneous therewith withdrawing said values from said deposit;

wherein the step of communicating reacting fluid to said formation is carried at a pressure of less than prevailing atmospheric pressure.

* * * * *